US007500761B2

(12) United States Patent
Tseng

(10) Patent No.: US 7,500,761 B2
(45) **Date of Patent: *Mar. 10, 2009**

(54) CIRCUIT DEVICE FOR CONTROLLING A PLURALITY OF LIGHT-EMITTING DEVICES IN A SEQUENCE

(76) Inventor: Shen-Ko Tseng, No. 187, Lane 75, Sec. 3, Kangning Rd., Neihu District, Taipei City (TW) 114

( * ) Notice: Subject to any disclaimer, the term of this patent is extended or adjusted under 35 U.S.C. 154(b) by 123 days.

This patent is subject to a terminal disclaimer.

(21) Appl. No.: 11/382,014

(22) Filed: May 6, 2006

(65) Prior Publication Data

US 2007/0258230 A1 Nov. 8, 2007

(51) Int. Cl.
*F21V 21/08* (2006.01)

(52) U.S. Cl. ..... 362/103; 362/231; 362/252; 362/394

(58) Field of Classification Search ..... 362/394, 362/231, 103, 105, 106, 108, 154, 155, 156, 362/230, 234, 251, 252, 800
See application file for complete search history.

(56) References Cited

U.S. PATENT DOCUMENTS 5,371,662 A * 12/1994 Shen-Ko ..... 362/276
5,746,499 A * 5/1998 Ratcliffe et al. ..... 362/103
5,813,148 A * 9/1998 Guerra ..... 36/137
5,927,845 A * 7/1999 Gustafson et al. ..... 362/152
5,947,580 A * 9/1999 Chien ..... 362/84
6,485,169 B1 * 11/2002 Ragner ..... 362/500
6,733,150 B1 * 5/2004 Hanley ..... 362/106
6,789,913 B2 * 9/2004 Wei ..... 362/103
6,824,291 B2 * 11/2004 Vautrin et al. ..... 362/156
6,935,761 B2 * 8/2005 Vanderschuit ..... 362/106
7,086,749 B1 * 8/2006 Hanley ..... 362/105
7,207,688 B2 * 4/2007 Yuen et al. ..... 362/103

* cited by examiner

*Primary Examiner*—Sandra L. O'Shea
*Assistant Examiner*—Gunyoung T. Lee
(74) *Attorney, Agent, or Firm*—Banger Shia

(57) ABSTRACT

The invention provides a circuit device, embedded in an object, which includes N light-emitting devices, a motion-actuated switch, a controller, a battery, and a water-proof enclosure, N is an integer larger than 2. In addition, each light-emitting device includes a respective first light-emitting diode and a second light-emitting diode. The motion-actuated switch is capable of sensing a motion of the object, for generating a controlling signal. The controller is electrically connected to the motion-actuated switch and each of the light-emitting devices for driving the first light-emitting diodes and the second diodes lighting on the basis of at least one lighting sequence when triggered by the controlling signal from the motion-actuated switch.

19 Claims, 4 Drawing Sheets

| Sequence No. | Sequence content |
|---|---|
| Sequence 1 | (R)1122–(R)1142–(R)1162–(B)1124–(B)1144–(B)1164 |
| Sequence 2 | (B)1124–(B)1144–(B)1164–(R)1122–(R)1142–(R)1162 |
| Sequence 3 | (R)1122–(R)1142–(R)1162–(B)1164–(B)1144–(B)1124 |
| Sequence 4 | (B)1124–(B)1144–(B)1164–(R)1162–(R)1142–(R)1122 |
| Sequence 5 | (R)1122–(B)1124–(R)1142–(B)1144–(R)1162–(B)1164 |
| Sequence 6 | (B)1124–(R)1122–(B)1144–(R)1142–(B)1164–(R)1162 |
| Sequence 7 | (R)1122–(B)1144–(R)1162–(B)1124–(R)1142–(B)1164 |
| Sequence 8 | (B)1124–(R)1142–(B)1164–(R)1122–(B)1144–(R)1162 |

FIG. 2

CIRCUIT DEVICE FOR CONTROLLING A PLURALITY OF LIGHT-EMITTING DEVICES IN A SEQUENCE

BACKGROUND OF THE INVENTION

1. Field of the Invention

The present invention relates generally to a circuit device, and more particularly to a circuit device for controlling a plurality of light-emitting devices in a sequence.

2. Description of the Prior Art

Poor illumination at night is a set back to night activities. There may be problems of difficult identification and safety. People jogging or cycling at night may be hit by cars due to insufficient illumination. Playing balls in open places may have to be stopped at night if the street lights are not strong enough. It is therefore necessary to find means to enhance the safety and smooth-going of night activities.

Footwear with flashing device is available on the market for reasons of safety described above. Such footwear typically includes at least one light source such as light emitting diodes (LEDs), a source of power such as a battery, and a switch to connect the battery to the light sources to illuminate them.

In addition, the switch could be a simple manual switch as disclosed, for example, in U.S. Pat. No. 4,158,922. The switch could be a mercury switch in which a ball of mercury runs back and forth along a tube between a pair of electrical contacts during motion of the footwear, as disclosed in U.S. Pat. No. 4,848,009. The switch can be a pressure responsive switch which opens and closes in response to application of the wearer's weight on the switch as disclosed, for example, in U.S. Pat. No. 5,285,586. The switch can be a spring switch in which a cantilevered spring in the form of a coil oscillates back and forth to make and break contact with an electrical terminal as, for example, shown in U.S. Pat. No. 5,408,764.

Moreover, to increase battery life and to provide a more attractive eye-catching and safer display, it is desirable to cause the lights to flash on and off, rather than being maintained continuously illuminated while the switch is closed. Such flash will be interesting and attractive if an eye-catching flashing pattern could be demonstrated from the LEDs.

Furthermore, to prevent the aforesaid device from the water and dust and therefore to extend the lifetime of such device, the system-in-package of the battery, the responsive switch, and the control circuit of the LEDs is also desired.

SUMMARY OF THE INVENTION

Accordingly, the aspect of the present invention is to provide a circuit device, and more particularly, to provide a circuit for controlling a plurality of light-emitting devices in a sequence. Furthermore, the circuit of the present invention is compact, and provides a strong illumination in an energy saving way.

In a preferred embodiment of the invention, the circuit device, embedded in an object, includes N light-emitting device, a motion-actuated switch, a controller, a power source, and a water-proof enclosure, N is an integer larger than 2.

Each of the N light-emitting devices includes a package, a lead set, a first light-emitting diode, and a second light-emitting diode. The first light-emitting diode and the second light emitting-diode are encapsulated in the package, and the lead set is electrically connected to the first light-emitting diode and the second light emitting-diode.

The motion-actuated switch is capable of generating a control signal in response to a motion of the object. In addition, the controller is electrically connected to the motion-actuated switch and the lead set of each light-emitting device for controlling the first light-emitting diode and the second light-emitting diode of each light-emitting device. The controller is capable of selectively driving the first light-emitting diode and the second light-emitting diode lighting on the basis of at least one sequence when receiving the control signal.

The power source is applied to supplying said circuit device with electrical power. Furthermore, the water-proof enclosure is applied to seal the motion-actuated switch, the controller, the power source, and a first end of the lead set of each light-emitting device.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

FIG. 2 is a listing of a plurality of lighting sequences of the light-emitting device 11 of FIG. 1.

DETAILED DESCRIPTION OF THE INVENTION

Figure 1:
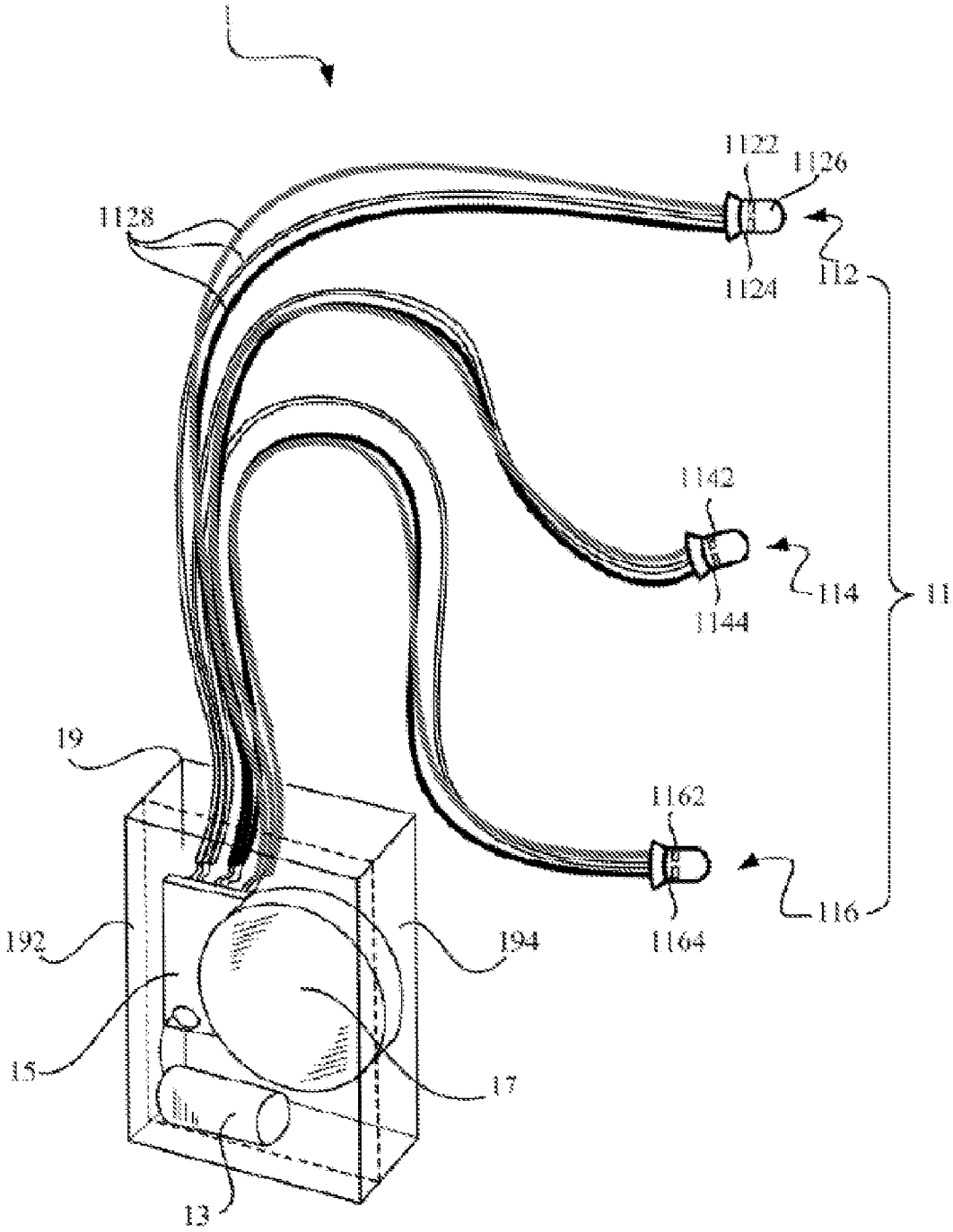
FIG. 1 is an elevational view of an embodiment of the present invention.

Please refer to FIG. 1A. FIG. 1 shows an elevation of a circuit device of an embodiment of the present invention. The circuit device 1 is capable of being embedded in an object (not shown), and the circuit device 1 includes N light-emitting devices 11, a motion-actuated switch 13, a controller 15, a power source 17, and a water-proof enclosure 19, and N is an integer larger than 2.

In the embodiment, N is equal to 3, and the three light-emitting devices 11 include a first light-emitting device 112, a second light-emitting device 114, and a third light-emitting device 116. Take the first light-emitting device 112 as an example, each of the N light-emitting devices includes a first light-emitting diode 1122, a second light-emitting diode 1124, a package 1126, and a lead set 1128. Moreover, the first light-emitting diode 1122 and the second light-emitting diode 1124 are encapsulated in the package 1126, and the lead set 1128 is electrically connected to the first light-emitting diode 1122 and the second light-emitting diode 1124 respectively. These light-emitting diodes could generate eye-catching pattern when flashing on a basis of lighting sequence.

In practice, the first light-emitting diode and the second light-emitting diode can be red light-emitting diode, blue light-emitting diode, green light-emitting diode, yellow light-emitting diode, or other suitable light-emitting diode.

Additionally, the water-proof enclosure 19 of the present invention is embedded in the object, for sealing the motion-actuated switch 13, the controller 15, the power source 17, and a first end of the lead set of each light-emitting device 11. Therefore, the water-proof enclosure 19 can keep the circuit device 1 from being wet, oxidation, or being contaminated, and further elongate the life of the circuit device 1. Furthermore, as shown in FIG. 1, the water-proof enclosure 19 includes a plastic container 194 and an upper plastic cover 192 bonded with the plastic container 194. Moreover, the water-proof enclosure 19 can be formed by fusing the upper plastic cover 192 to the surroundings of the plastic container 194 by supersonic wave or laser light. In addition, in practice, the water-proof enclosure can be formed by injection molding of resin or plastic.

The motion-actuated switch 13 is capable of generating a control signal in response to a motion of the object. Additionally, the controller 15 is electrically connected to the motion-actuated switch 13 and the lead set of each light-emitting device 11, for controlling the first light-emitting diode 1122, 1142, 1162 and the second light-emitting diode 1124, 1144, 1164 of each light-emitting device 11. The controller 15 is capable of selectively driving the first light-emitting diode 1122, 1142, 1162 and the second light-emitting diode 1124, 1144, 1164 lighting on the basis of at least one lighting sequence when receiving the control signal from the motion-actuated switch 13.

Furthermore, the power source 17 is applied to supply the circuit device 1 with electrical power. In practice, when the first light-emitting diode of each of the N light-emitting devices is a red light-emitting diode, and the second light-emitting diode of each of the N light-emitting devices is a blue light-emitting diode, the power source includes a series of two 3V lithium batteries to provide a voltage of 6V. Moreover, the positive electrode of the series of two 3V lithium batteries is electrically connected to the positive electrode of the first light-emitting diode and the second light-emitting diode. It should be noted that the design of the series of 3V lithium batteries is based on the requirement of lighting of the blue light-emitting diode.

In practice, when the first light-emitting diode of each of the N light-emitting devices is a red light-emitting diode, and the second light-emitting diode of each of the N light-emitting devices is a green light-emitting diode, the power source includes a 3V lithium battery, and the positive electrode of the 3V lithium battery is electrically connected to the positive electrode of the first light-emitting diode and the second light-emitting diode. It should be noted that the design of the power source is based on the requirement of lighting of the red light-emitting diode and the green light-emitting diode.

Referring to FIG. 2, FIG. 2 is a listing of a plurality of lighting sequences of the light-emitting device 11 of FIG. 1, for detail description of the invention. In addition, the first light-emitting diode 1122, 1142, 1162 of each of the N light-emitting devices is red light-emitting diode (R), and the second light-emitting diode 1124, 1144, 1164 of each of the N light-emitting devices is blue light-emitting diode (B) as described hereinbefore. As shown in FIG. 2, the lighting sequences of the light-emitting device can be:

Sequence 1: the red light-emitting diode (R) 1122 of the first light-emitting device 112—the red light-emitting diode (R) 1142 of the second light-emitting device 114—the red light-emitting diode (R) 1162 of the third light-emitting device 116—the blue light-emitting diode (B) 1124 of the first light-emitting device 112—the blue light-emitting diode (B) 1144 of the second light-emitting device 114—the blue light-emitting diode (B) 1164 of the third light-emitting device 116.

Sequence 2: the blue light-emitting diode (B) 1124 of the first light-emitting device 112—the blue light-emitting diode (B) 1144 of the second light-emitting device 114—the blue light-emitting diode (B) 1164 of the third light-emitting device 116—the red light-emitting diode (R) 1122 of the first light-emitting device 112—the red light-emitting diode (R) 1142 of the second light-emitting device 114—the red light-emitting diode (R) 1162 of the third light-emitting device 116.

Sequence 3: the red light-emitting diode (R) 1122 of the first light-emitting device 112—the red light-emitting diode (R) 1142 of the second light-emitting device 114—the red light-emitting diode (R) 1162 of the third light-emitting device 116—the blue light-emitting diode (B) 1164 of the third light-emitting device 116—the blue light-emitting diode (B) 1144 of the second light-emitting device 114—the blue light-emitting diode (B) 1124 of the first light-emitting device 112.

Sequence 4: the blue light-emitting diode (B) 1124 of the first light-emitting device 112—the blue light-emitting diode (B) 1144 of the second light-emitting device 114—the blue light-emitting diode (B) 1164 of the third light-emitting device 116—the red light-emitting diode (R) 1162 of the third light-emitting device 116—the red light-emitting diode (R) 1142 of the second light-emitting device 114—the red light-emitting diode (R) 1122 of the first light-emitting device 112.

Sequence 5: the red light-emitting diode (R) 1122 of the first light-emitting device 112—the blue light-emitting diode (B) 1124 of the first light-emitting device 112—the red light-emitting diode (R) 1142 of the second light-emitting device 114—the blue light-emitting diode (B) 1144 of the second light-emitting device 114—the red light-emitting diode (R) 1162 of the third light-emitting device 116—the blue light-emitting diode (B) 1164 of the third light-emitting device 116.

Sequence 6: the blue light-emitting diode (B) 1124 of the first light-emitting device 112—the red light-emitting diode (R) 1122 of the first light-emitting device 112—the blue light-emitting diode (B) 1144 of the second light-emitting device 114—the red light-emitting diode (R) 1142 of the second light-emitting device 114—the blue light-emitting diode (B) 1164 of the third light-emitting device 116—the red light-emitting diode (R) 1162 of the third light-emitting device 116.

Sequence 7: the red light-emitting diode (R) 1122 of the first light-emitting device 112—the blue light-emitting diode (B) 1144 of the second light-emitting device 114—the red light-emitting diode (R) 1162 of the third light-emitting device 116—the blue light-emitting diode (B) 1124 of the first light-emitting device 112—the red light-emitting diode (R) 1142 of the second light-emitting device 114—the blue light-emitting diode (B) 1164 of the third light-emitting device 116.

Sequence 8: the blue light-emitting diode (B) 1124 of the first light-emitting device 112—the red light-emitting diode (R) 1142 of the second light-emitting device 114—the blue light-emitting diode (B) 1164 of the third light-emitting device 116—the red light-emitting diode (R) 1122 of the first light-emitting device 112—the blue light-emitting diode (B) 1144 of the second light-emitting device 114—the red light-emitting diode (R) 1162 of the third light-emitting device 116.

It should be noted that the lighting sequences described above are only some examples of the present invention, the lighting sequence of the present invention can be other suitable lighting sequences.

Figure 3:
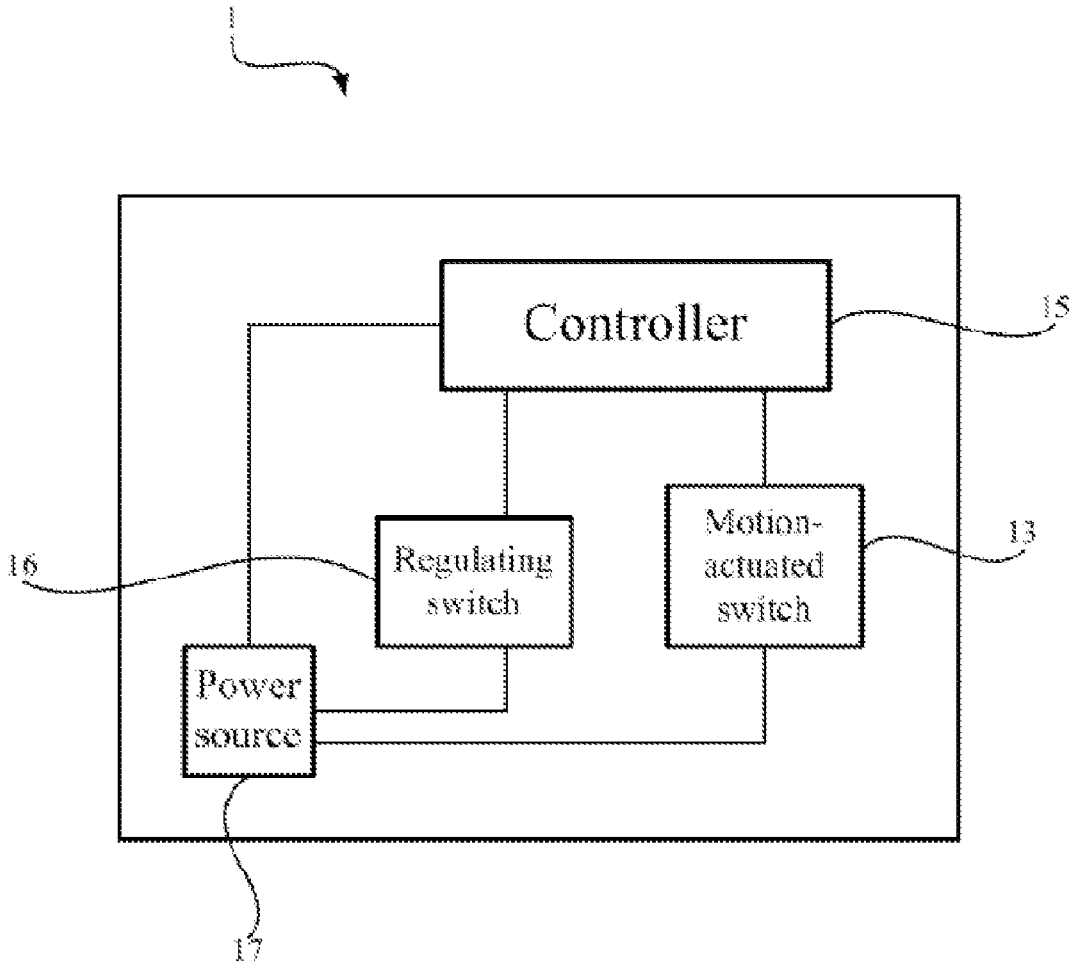
FIG. 3 shows a functional block of a circuit device according to the present invention.

Referring to FIG. 3, FIG. 3 shows a functional block of a circuit device according to the present invention. As shown in FIG. 3, except for the motion-actuated switch 13, the controller 15, and the power source 17 as described above, the circuit device 1 further includes a regulating switch 16. Moreover, the controller 15 is pre-stored with the at least one lighting sequence. The regulating switch 16 is electrically connected to the controller 15, for selecting one of the at least one lighting sequence based on a predetermined condition.

In practice, the regulating switch can be a manual switch, which can be set manually by the user to regulate the controller to drive the first light-emitting diode and the second light-emitting diode lighting on the basis of a lighting sequence. In practice, the regulating switch can be a sound switch, which can select one of the at least one lighting sequence in the controller in accordance with the strength of sound. For instance, when the strength of sound is weak, the sound switch can regulate the controller to drive the first light-emitting diode and the second light-emitting diode lighting on the basis of a first lighting sequence, such as the sequence 1 as shown in FIG. 2, whereas when the strength of sound is weak, the sound switch can regulate the controller to drive the first light-emitting diode and the second light-emitting diode lighting on the basis of a first lighting sequence, such as the sequence 6 as shown in FIG. 2.

In practice, the regulating switch can be a pressure switch, which can select one of the at least one lighting sequence in the controller according to the strength of force it received. For example, when the circuit device is disposed in a pair of shoes, and a user wears the pair of shoes and walks on a street, the pressure switch receives a weak force and can regulate the controller to drive the first light-emitting diode and the second light-emitting diode lighting on the basis of a first lighting sequence, such as the sequence 2 as shown in FIG. 2; and when the user wears the pair of shoes and runs on a field, the pressure switch receives a stronger force and can regulate the controller to drive the first light-emitting diode and the second light-emitting diode lighting on the basis of a first lighting sequence, such as the sequence 7 as shown in FIG. 2.

Furthermore, in practice, the regulating switch can be an optical switch, such as a light-emitting sensitive resistor, which can select one of the at least one lighting sequence in the controller in accordance with the strength of light. For example, when the strength of light is strong, such as in the daytime, the optical switch can regulate the controller to drive the first light-emitting diode and the second light-emitting diode lighting on the basis of a first lighting sequence, such as the sequence 1 as shown in FIG. 2; when the strength of light is weak, such as in the evening, the optical switch can regulate the controller to drive the first light-emitting diode and the second light-emitting emitting diode lighting on the basis of a second lighting sequence, such as the sequence 3 as shown in FIG. 2; and when the strength of light is faint, such as in the night, the optical switch can regulate the controller to drive the first light-emitting diode and the second light-emitting diode lighting on the basis of a third lighting sequence, such as the sequence 5 as shown in FIG. 2.

Figure 4:
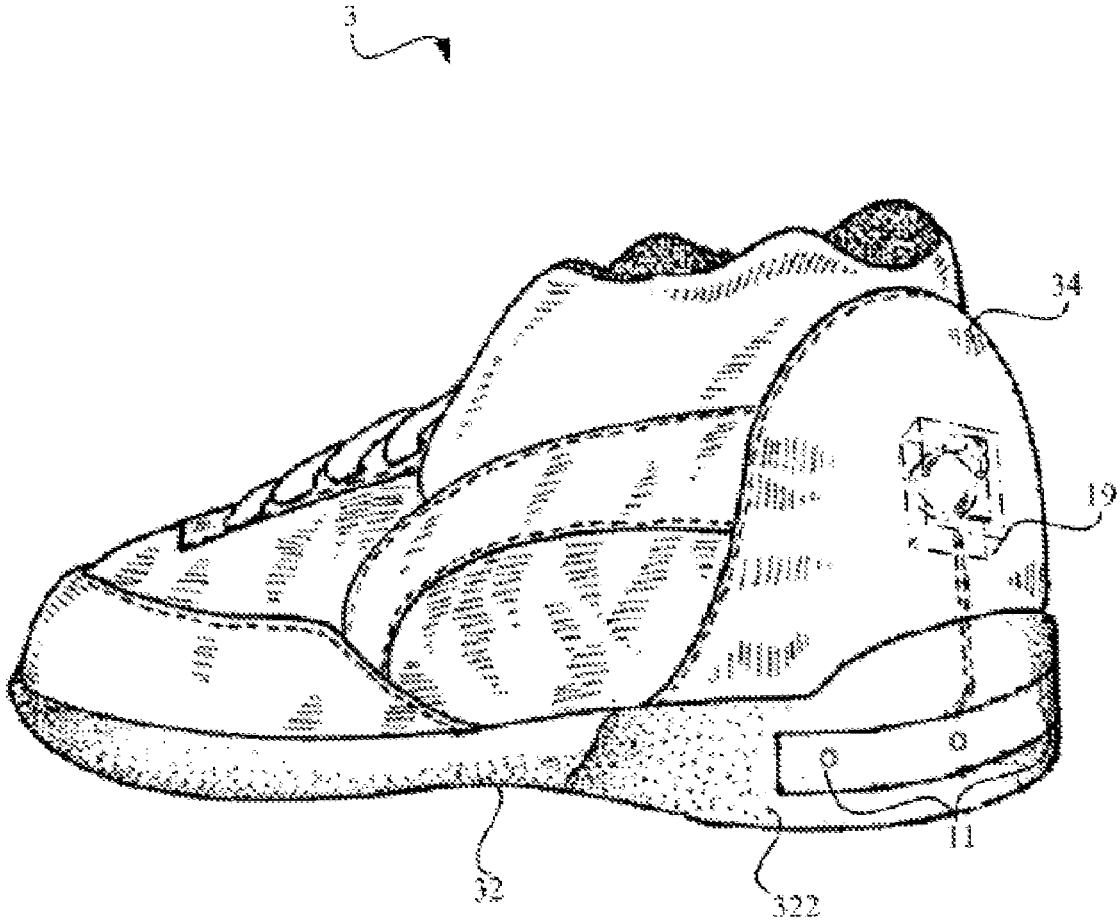
FIG. 4 illustrates an embodiment of the present invention.

In practice, the object in accordance with the present invention can be but not limited to shoes, such as casual shoes, sports shoes, and leather shoes; a garment, such as a jacket, a waistcoat, a raincoat, and a sports wear; an accessory, such as a handbag, a backpack, a watch, a belt, and a hat. Please refer to FIG. 4, which shows a schematic diagram of the circuit device disposed on a shoe 3. As shown in FIG. 4, the light-emitting devices 11 are disposed in a heel portion 322 of the sole 32, whereas the water-proof enclosure 19 of the present invention is disposed in a back portion 34. When the wearer walks or runs, the motion-actuated switch will trigger the controller for driving the light-emitting devices 11 lighting/flashing in the predetermined way, such as the lighting sequences described above. Furthermore, the lighting or flashing of the light-emitting devices provides a strong and safety illumination when the wearer walks or runs at night.

Obviously, the circuit of the present invention is compact, energy saving, and may be adapted for use in many different objects and articles to provide a strong illumination for night activities.

Although the present invention has been illustrated and described with reference to the preferred embodiment thereof, it should be understood that it is in no way limited to the details of such embodiment but is capable of numerous modifications within the scope of the appended claims.

What is claimed is:

1. A circuit device for being embedded in an object, said circuit device comprising:

N light-emitting devices, N being an integer larger than 2, and each of the N light-emitting devices comprising a package, a lead set, a first light-emitting diode, and a second light-emitting diode, wherein the first light-emitting diode and the second light-emitting diode are both encapsulated in the package and the lead set is electronically connected to the first light-emitting diode and the second light-emitting diode;

a motion-actuated switch, for generating a control signal in response to a motion of the object;

a controller storing a plurality of lighting sequences and electrically connected to the motion-actuated switch and the lead set of each of the N light-emitting devices, the controller selectively driving each of the N light-emitting devices based on one of the plurality of lighting sequences when receiving the control signal;

a power source, for supplying said circuit device with electrical power;

a water-proof and dust-proof enclosure, for sealing the motion-actuated switch, the controller, the power source, and a first end of the lead set of each light-emitting device; and a regulating switch electrically connected to the controller for, based on the strength of a physical parameter, selecting the one of the plurality of lighting sequences stored in the controller for the controller to drive each of the N light-emitting devices.

2. The circuit device of claim 1, wherein the first light-emitting diode of each of the N light-emitting devices is a red light-emitting diode, and the second light-emitting diode of each of the N light-emitting devices is a blue light-emitting diode.

3. The circuit device of claim 2, wherein the power source comprises a series of two lithium batteries and the positive electrode of the series of two-lithium batteries is electrically connected to the positive electrode of the second light-emitting diode, wherein the voltage of each lithium battery is 3 volts.

4. The circuit device of claim 3, wherein the N light-emitting devices comprises a first light-emitting device, a second light-emitting device, and a third light-emitting device, and one of the plurality of lighting sequences is: the red light-emitting diode of the first light-emitting device on, then the red light-emitting diode of the second light-emitting device on, then the red light-emitting diode of the third light-emitting device on, then the blue light-emitting diode of the first light-emitting device on, then the blue light-emitting diode of the second light-emitting device on, and then the blue light-emitting diode of the third light-emitting device on.

5. The circuit device of claim 3, wherein the N light-emitting devices comprises a first light-emitting device, a second light-emitting device, and a third light -emitting device, and one of the plurality of lighting sequences is: the red light-emitting diode of the first light-emitting device on, then the red light-emitting diode of the second light-emitting device on, then the red light-emitting diode of the third light-emitting device on, then the blue light-emitting diode of the third light-emitting device on, then the blue light-emitting diode of the second light-emitting device on, and then the blue light-emitting diode of the first light-emitting device on.

6. The circuit device of claim 3, wherein the N light-emitting devices comprises a first light-emitting device, a second light-emitting device, and a third light-emitting device, and one of the plumlity of lighting sequences is: the red light-emitting diode of the first light-emitting device on, then the blue light-emitting diode of the second light-emitting device on, then the red light-emitting diode of the third light-emitting device on, then the blue light-emitting diode of the first light-emitting device on, then the red light-emitting diode of the second light-emitting device on, and then the blue light-emitting diode of the third light-emitting device on.

7. The circuit device of claim 3, wherein the N light-emitting devices comprises a first light-emitting device, a second light-emitting device, and a third light-emitting device, and one of the plumlity of lighting sequences is: the red light-emitting diode of the first light-emitting device on, then the blue light-emitting diode of the first light-emitting device on, then the red light-emitting diode of the second light-emitting device on, then the blue light-emitting diode of the second light-emitting device on, then the red light-emitting diode of the third light-emitting device on, and then the blue light-emitting diode of the third light-emitting device on.

8. The circuit device of claim 1, wherein the first light-emitting diode of each of the N light-emitting devices is a red light-emitting diode, and the second light-emitting diode of each of the N light-emitting devices is a green light-emitting diode.

9. The circuit device of claim 8, wherein the power source comprises a lithium battery and the positive electrode of the lithium battery is electrically connected both to the positive electrode of the first light-emitting diode and the second light-emitting diode, wherein the voltage of the lithium battery is 3 volts.

10. The circuit device of claim 9, wherein the N light-emitting devices comprises a first light-emitting device, a second light-emitting device, and a third light-emitting device, and one of the plurality of lighting sequences is: the red light-emitting diode of the first light-emitting device on, then the red light-emitting diode of the second light-emitting device on, then the red light-emitting diode of the third light-emitting device on, then the blue light-emitting diode of the first light-emitting device on, then the blue light-emitting diode of the second light-emitting device on, and then the blue light-emitting diode of the third light-emitting device on.

11. The circuit device of claim 9, wherein the N light-emitting devices comprises a first light-emitting device, a second light-emitting device, and a third light-emitting device, and one of the plurality of lighting sequences is: the red light-emitting diode of the first light-emitting device on, then the red light-emitting diode of the second light-emitting device on, then the red light-emitting diode of the third light-emitting device on, then the blue light-emitting diode of the third light-emitting device on, then the blue light-emitting diode of the second light-emitting device on, and then the blue light-emitting diode of the first light-emitting device on.

12. The circuit device of claim 9, wherein the N light-emitting devices comprises a first light-emitting device, a second light-emitting device, and a third light-emitting device, and one of the plurality of lighting sequences is: the red light-emitting diode of the first light-emitting device on, then the blue light-emitting diode of the second light-emitting device on, then the red light-emitting diode of the third light-emitting device on, then the blue light-emitting diode of the first light-emitting device on, then the red light-emitting diode of the second light-emitting device on, and then the blue light-emitting diode of the third light-emitting device on.

13. The circuit device of claim 9, wherein the N light-emitting devices comprises a first light-emitting device, a second light-emitting device, and a third light-emitting device, and one of the plurality of lighting sequences is: the red light-emitting diode of the first light-emitting device on, then the blue light-emitting diode of the first light-emitting device on, then the red light-emitting diode of the second light-emitting device on, then the blue light-emitting diode of the second light-emitting device on, then the red light-emitting diode of the third light-emitting device on, and then the blue light-emitting diode of the third light-emitting device on.

14. The circuit device of claim 1, wherein the object is one selected from the group consisting of a shoe, a garment, a handbag, a rucksack, and a cap.

15. The circuit device of claim 1, wherein the water-proof enclosure is formed by injection molding of resin or plastic.

16. The circuit device of claim 1, wherein the water-proof enclosure comprises a plastic container and an upper plastic cover bonded with the plastic container.

17. The circuit device of claim 16, wherein the water-proof enclosure is formed by fusing the upper plastic cover with the plastic container by supersonic wave or laser light.

18. The circuit device of claim 1, wherein the regulating switch is one selected from the group consisting of a manual switch, an optical switch, a pressure switch and a sound switch.

19. A circuit device for being embedded in an object, said circuit device comprising:

three light-emitting devices comprising a first light-emitting device, a second light-emitting device and a third light-emitting device, each of the three light-emitting devices comprising a package, a lead set, a first light-emitting diode, and a second light-emitting diode, wherein the first light-emitting diode and the second light-emitting diode are both encapsulated in the package and the lead set is electronically connected to the first light-emitting diode and the second light-emitting diode;

a motion-actuated switch, for generating a control signal in response to a motion of the object;

a controller storing a plurality of the lighting sequences and electrically connected to the motion-actuated switch and the lead set of each of the three light-emitting device;

a regulating switch electrically connected to the controller for, based on the strength of a physical parameter, selecting the one of the plurality lighting sequences stored in the controller;

the controller driving each of the N light-emitting devices based on the selected lighting sequence by the regulating switch when receiving the control signal;

a power source, for supplying said circuit device with electrical power; and a water-proof and dust-proof enclosure, for sealing the motion-actuated switch, the controller, the power source, and a first end of the lead set of each light-emitting device;

wherein the plurality of lighting sequence is selected from the group consisting of: (a) the first light-emitting diode of the first light-emitting device on, then the first light-emitting diode of the second light-emitting device on, then the first light-emitting diode of the third light-emitting device on, then the second light-emitting diode of the first light-emitting device on, then the second light-emitting diode of the second light-emitting device on, and then the second light-emitting diode of the third light-emitting device on; (b) the first light-emitting diode of the first light-emitting device on, then the first light-emitting diode of the second light-emitting device on, then the first light-emitting diode of the third light-emitting device on, then the second light-emitting diode of the third light-emitting device on, then the second light-emitting diode of the second light-emitting device on, and then the second light-emitting diode of the first light-emitting device on; (c) the first light-emitting diode of the first light-emitting device on, then the second light-emitting diode of the second light-emitting device on, then the first light-emitting diode of the third light-emitting device on, then the second light-emitting diode of the first light-emitting device on, then the first light-emitting diode of the second light-emitting device on, and then the second light-emitting diode of the third light-emitting device on, and (d) the first light-emitting diode of the first light-emitting device on, then the second light-emitting diode of the first light-emitting device on, then the first light-emitting diode of the second light-emitting device on, then the second light-emitting diode of the second light-emitting device on, then the first light-emitting diode of the third light-emitting device on, and then the second light-emitting diode of the third light-emitting device on.

* * * * *